US008128320B2

(12) United States Patent
Heselden

(10) Patent No.: US 8,128,320 B2
(45) **Date of Patent: *Mar. 6, 2012**

(54) GABIONS

(75) Inventor: James Heselden, Leeds (GB)

(73) Assignee: Hesco Bastion Limited, Leeds, Yorkshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/182,262

(22) Filed: Jul. 13, 2011

(65) Prior Publication Data

US 2011/0286807 A1 Nov. 24, 2011

Related U.S. Application Data

(63) Continuation of application No. 12/905,832, filed on Oct. 15, 2010, now Pat. No. 8,038,369, which is a continuation of application No. 12/090,352, filed on May 8, 2008, now Pat. No. 7,854,574.

(51) Int. Cl.
*E02B 3/06* (2006.01)

(52) U.S. Cl. ..... 405/284; 405/258.1; 405/21; 206/494

(58) Field of Classification Search ..... 405/15, 405/16, 21, 30, 32, 284, 287, 287.1
See application file for complete search history.

(56) References Cited

U.S. PATENT DOCUMENTS

| | | | |
|---|---|---|---|
| 2,121,173 | A | 6/1938 | MacPherson |
| 3,478,999 | A | 11/1969 | Charman et al. |
| 4,483,540 | A | 11/1984 | Bordien et al. |
| 4,483,640 | A | 11/1984 | Berger et al. |
| 4,498,592 | A | 2/1985 | Colucci |
| 4,530,622 | A | 7/1985 | Mercer |
| 5,176,469 | A | 1/1993 | Alsop |
| 5,333,970 | A | 8/1994 | Heselden |
| 5,368,410 | A | 11/1994 | Ferraiolo |
| 5,472,297 | A | 12/1995 | Heselden |
| 5,482,408 | A | 1/1996 | Lunardi |
| 5,638,938 | A | 6/1997 | Lazzarotti et al. |
| 5,647,695 | A | 7/1997 | Hilfiker et al. |
| 5,788,424 | A | 8/1998 | Torch |
| 6,764,252 | B2 | 7/2004 | Banting |

(Continued)

FOREIGN PATENT DOCUMENTS

| | | |
|---|---|---|
| CA | 2108964 | 4/1995 |

(Continued)

OTHER PUBLICATIONS

International Search Report, International Patent Application No. PCT/GB2006/050256, filed Aug. 23, 2006.

(Continued)

*Primary Examiner* — David Bagnell
*Assistant Examiner* — Benjamin Fiorello
(74) *Attorney, Agent, or Firm* — Ping Wang; Andrews Kurth, LLP

(57) ABSTRACT

The invention provides a gabion which may be used to protect military or civilian installations from weapons assault or from elemental forces, such as flood waters, lava flows, avalanches, soil instability, slope erosion and the like, the gabion comprising side walls connected together at spaced intervals by partition walls, the side walls comprising at least one substantially closed side wall element panel, which acts in use of the gabion to prevent a gabion fill material from falling through the side wall, the said action of the substantially closed side wall element panel being effective without the aid of a gabion lining material.

17 Claims, 11 Drawing Sheets

U.S. PATENT DOCUMENTS

| | | | |
|---|---|---|---|
| 2002/0100763 | A1 | 8/2002 | Carriere |
| 2003/0035690 | A1 | 2/2003 | Earl |
| 2003/0145526 | A1 | 8/2003 | Rothfuss |
| 2006/0275084 | A1 | 12/2006 | Harbeck |

FOREIGN PATENT DOCUMENTS

| | | |
|---|---|---|
| DE | 20014332 | 1/2001 |
| EP | 0466726 | 1/1992 |
| EP | 0735198 | 10/1996 |
| EP | 0816572 | 1/1998 |
| GB | 2293190 | 3/1996 |
| GB | 200040810 | 7/2000 |
| GB | 2423107 | 8/2006 |
| JP | 57-146835 | 9/1982 |
| JP | 2002167766 | 12/2000 |
| JP | 2004194609 | 12/2002 |
| NL | 1024629 | 10/2003 |
| WO | 9012160 | 10/1990 |
| WO | 2005080691 | 9/2005 |
| WO | 2007/060475 | 5/2007 |
| WO | 2008/020247 | 2/2008 |

OTHER PUBLICATIONS

United Kingdom Search Report, GB Application No. 0619038.3.

International Search Report and Written Opinion of PCT/GB2007/050760.

United Kingdom Search Report for GB Application No. 0700001.1, filed Jan. 2, 2007.

FIG.10.
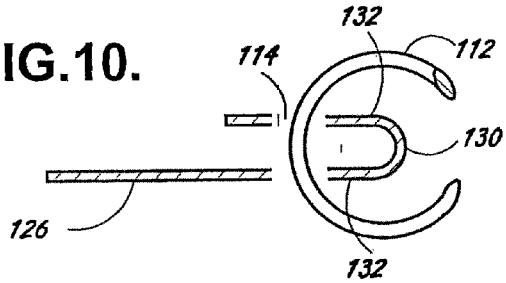
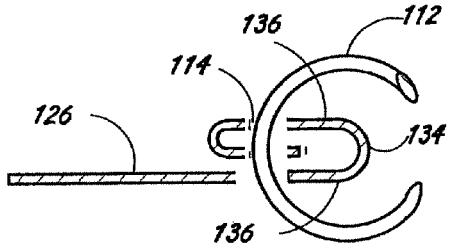
FIG.11.
FIG.12.
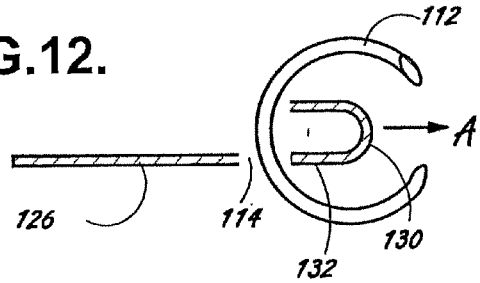
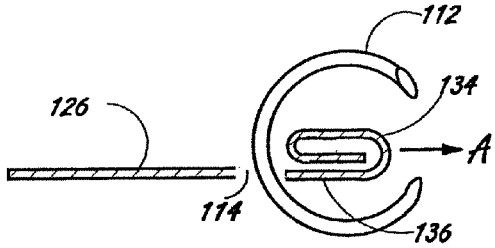
FIG.13.
FIG.14.
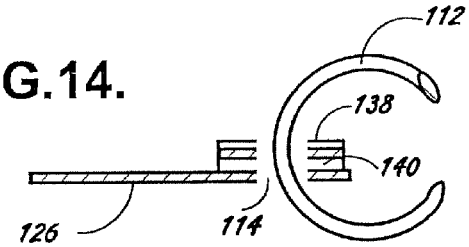
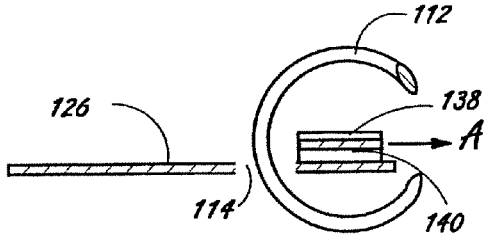
FIG.15.

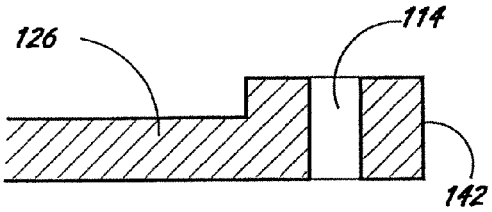
FIG.16.
FIG.17.
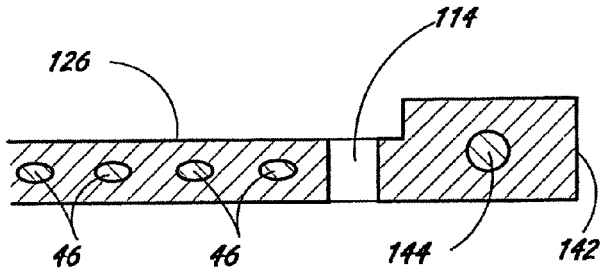
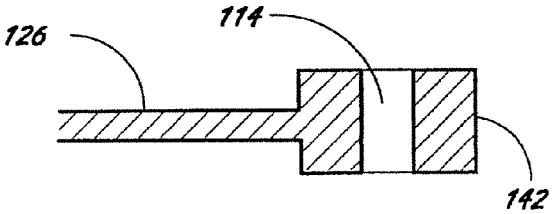
FIG.18.
FIG.19.
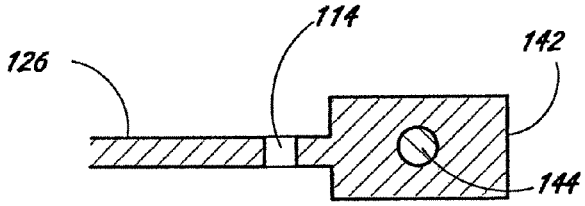

GABIONS

This application is a continuation application of U.S. patent application Ser. No. 12/905,832, filed Oct. 15, 2010 now U.S. Pat. No. 8,038,369, which is a continuation of U.S. patent application Ser. No. 12/090,352, filed May 8, 2008 now U.S. Pat. No. 7,854,574, which claims priority to International Patent Application No. PCT/GB2006/050256, filed Aug. 23, 2006, which claims priority to United Kingdom patent Application Nos. 0523927.2, filed Nov. 24, 2005 and 0606408.3, filed Mar. 30, 2006. The entirety of all of the aforementioned applications is incorporated herein by reference.

FIELD

The present invention relates to a gabion, particularly to a gabion, and especially to a multi-compartmental gabion, which can be used without a lining material.

BACKGROUND

Gabions are temporary or semi-permanent fortification structures which are used to protect military or civilian installations from weapons assault or from elemental forces, such as flood waters, lava flows, avalanches, slope erosion, soil instability and the like. WO-A-90/12160 discloses wire mesh cage structures useful as gabions. The cage structure is made up of pivotally interconnected open mesh work frames which are connected together under factory conditions so that the cage can fold concertina-wise to take a flattened form for transportation to a site, where it can be erected to take an open multi-compartmental form for filling with a suitable fill material, such as sand, soil, earth or rocks.

WO-A-00/40810 also concerns a multi-compartmental gabion which folds concertina-wise for transportation, and which comprises side walls extending along the length of the multi-compartmental gabion, the side walls being connected at spaced intervals along the length of the gabion by partition walls which are formed from two releasably connected sections, which after use of the gabion can be released, and the gabion unzipped for recovery purposes.

Existing gabions have certain disadvantages with respect to construction and longevity. For example, such gabions frequently comprise a wire mesh cage structure lined with a geotextile material, the lining adding to the cost and complexity of the gabion structure, and constituting a significant limitation on the functionality of the gabion after deployment over a long period of time. Particularly in harsh environmental conditions (intense sunlight, wind, rain, snow, sand or salt spray, or a combination of any two or more of these), the geotextile material tends to degrade and this can weaken the functionality of the gabion by, for example, the occurrence of rips, tears or holes in the liner, through which the gabion fill material can fall.

BRIEF DESCRIPTION OF THE FIGURES

The invention will now be more particularly described with reference to the following drawings, in which:

FIGS. 10 to 15 show different partial cross-sections through edges of the walls;

FIGS. 16 to 19 show different partial cross-sections through edges of the walls.

DETAILED DESCRIPTION

Figure 1A:
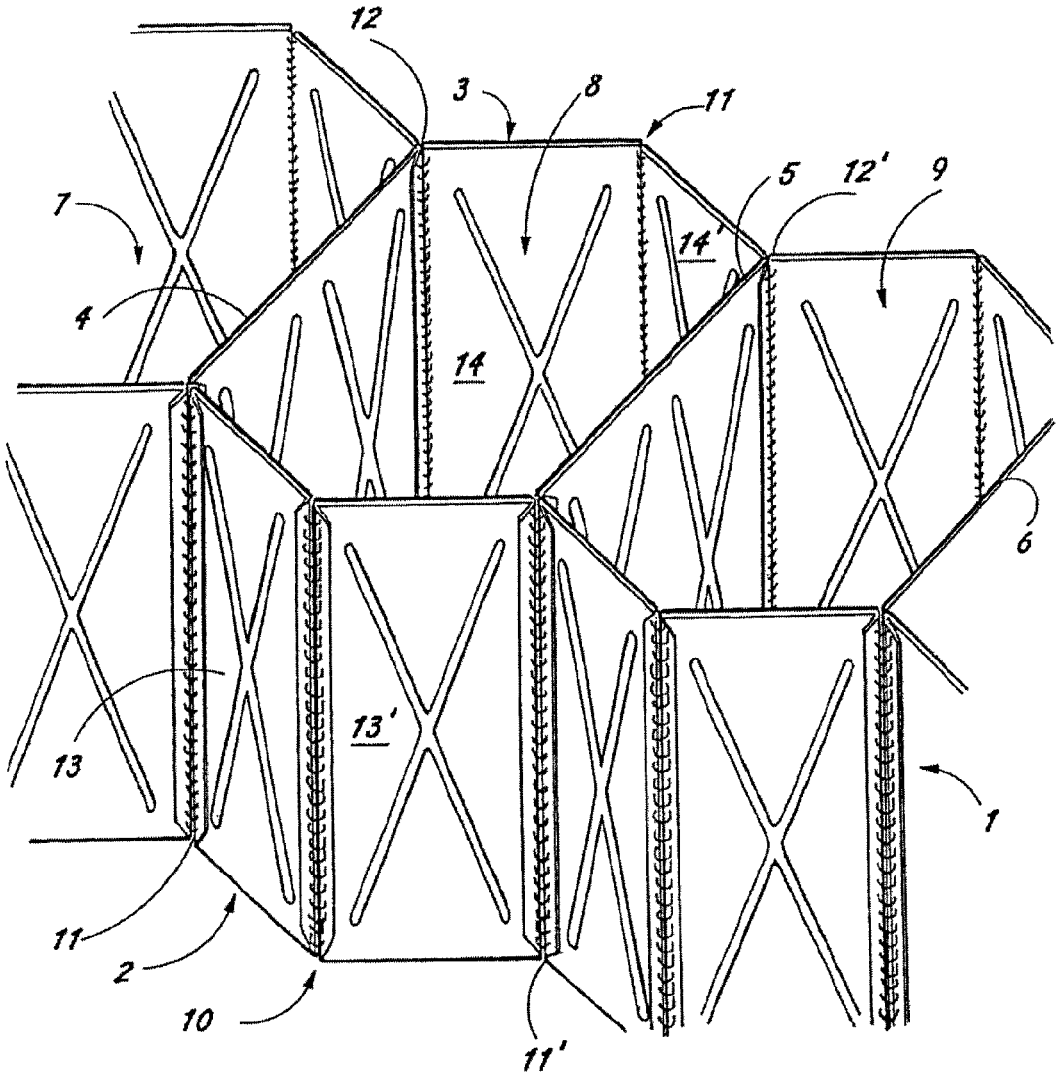
FIGS. 1A-1C shows a perspective view of a multi-compartmental gabion in accordance with the invention.
Figure 1B:
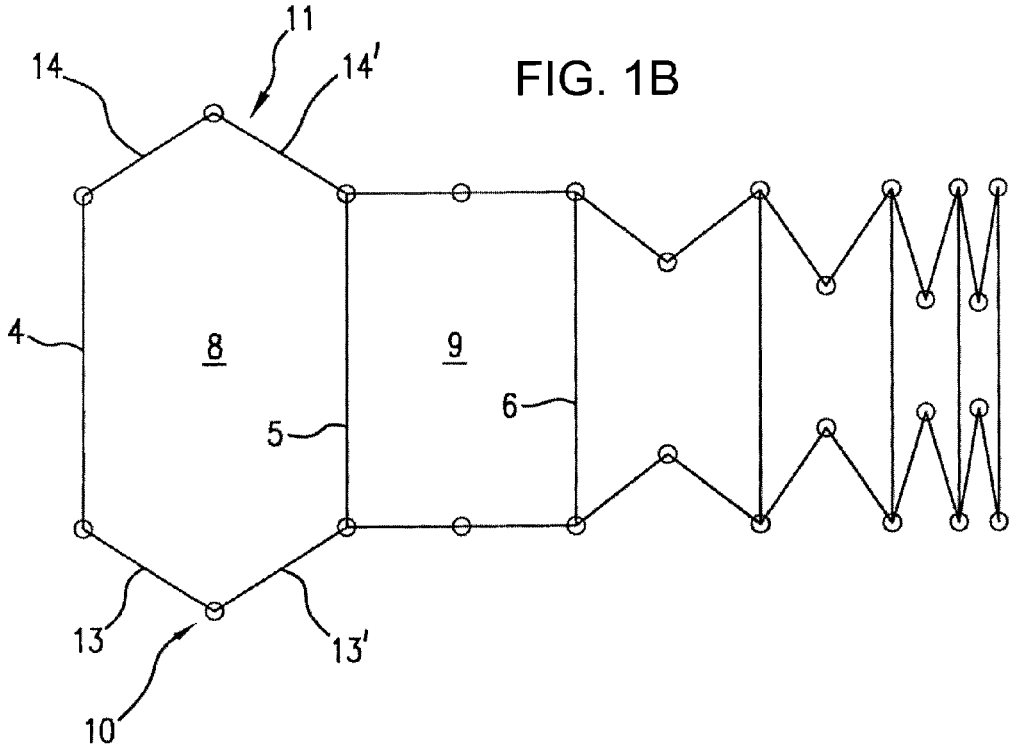
Figure 1C:
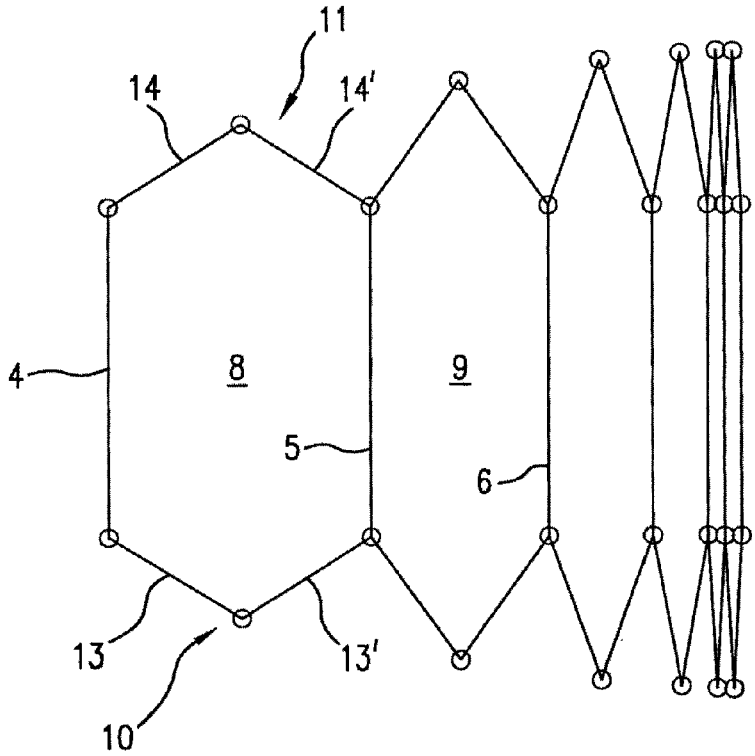

Accordingly, there is a need for an improved gabion. There is also a need for an improved multi-compartmental gabion.

According to the present invention there is provided a gabion comprising side walls connected together at spaced intervals by partition walls, the side walls comprising at least one substantially closed side wall element panel, wherein the or each substantially closed side wall element is manufactured of a relatively rigid sheet material.

According to the present invention there is provided a multi-compartmental gabion comprising opposed side walls connected together at spaced intervals along the length of the gabion by a plurality of partition walls, the side walls comprising a plurality of side wall element panels, at least one side wall element panel comprising a substantially closed panel, wherein the or each substantially closed side wall element is manufactured of a relatively rigid sheet material.

The substantially closed panel acts in use of the gabion to prevent a gabion fill material (sand, earth, soil, stones or fines, for example) from falling through the side wall without the aid of a gabion lining material.

Preferably, the rigidity of the material is sufficient to prevent excessive bulging of the side wall element panel when the gabion is filled with a fill material.

Other desirable characteristics of the sheet material include, either alone or in combination:

Durability
Toughness
Tear resistance
Scratch and erosion resistance
Corrosion resistance
Thermal stability
Ultraviolet stability
Low density
Low cost
Recyclability Suitable materials include steel, aluminum, titanium, other metals, alloys, plastic or certain natural materials, or combinations of two or more thereof. Where a metal is used, it is preferably either treated for corrosion resistance, e.g. by galvanisation and/or painting or is inherently corrosion resistant, e.g. a stainless steel.

Where the sheet material is a plastic material it may be polyethylene (PE), polypropylene (PP) or a composite such as glass fibre reinforced polymer (GFRP). The molecular weight of the chosen plastic can be selected to suit the application (e.g. LDPE, HDPE, LDPP, HDPP). Where plastic are used, they are preferably ultraviolet stabilised e.g. by the addition of fillers to prevent them becoming discoloured and/or brittle upon extended exposure to sunlight.

In certain circumstances, it may be desirable to add coloured fillers to the plastic material to provide a desired aesthetic effect. In one aspect of the invention, more than one colour filler is added to the plastic material and partially blended therewith to create a non-homogeneous coloured/marbled effect. For example; green and brown; white and grey; or yellow and brown colour fillers could be added to provide camouflage for vegetated, snowy or dessert environments, respectively. Because such colours are integral with the sheet material (i.e. not a surface decoration), they are less susceptible to removal by erosion (e.g. by sand in a sandstorm).

It is desirable to make the sheet material as thin as possible to reduce the folded volume of the gabion when being stored or transported. A major advantage of using thin-sheet materials is weight saving, which reduces transportation costs and facilitates manual deployment/rearrangement of the gabion.

The substantially closed panel is preferably provided with means for receiving a hinge member for the purpose of connecting the substantially closed panel pivotally to a neighbouring side wall element panel. The hinge receiving means are preferably provided on a region of the closed panel of greater thickness than an adjacent region of the panel. This helps to prevent tearing of the panel by the hinge member in use of the gabion when the side walls of the gabion act to restrain the gabion fill material. The region of the closed panel of relatively greater thickness is preferably provided at or in the region of an interconnection edge of the closed panel. Preferably, the region of relatively greater thickness is an elongated panel region alongside or at the interconnection edge.

Figure 7:
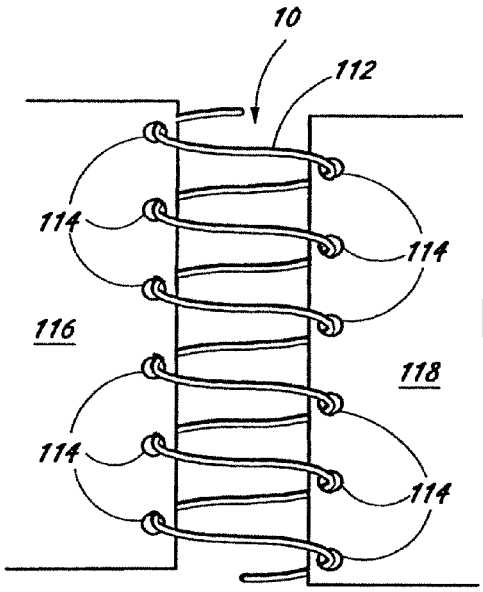
FIG. 7 shows a close-up of a hinged connection of a gabion according to the invention.
Figure 8:
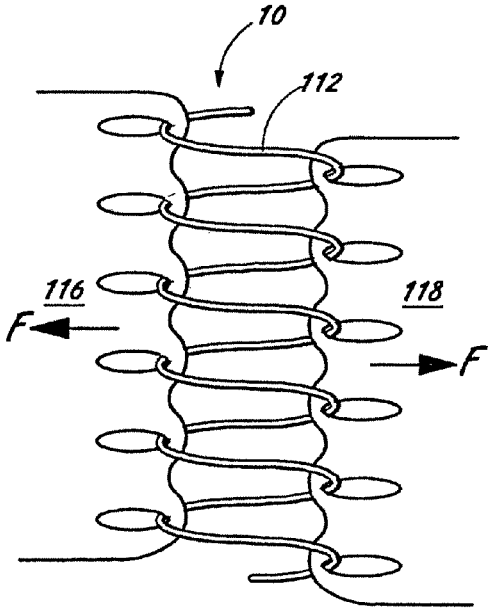
FIG. 8 shows a close-up of a hinged connection of a gabion according to the invention under load.
Figure 9:
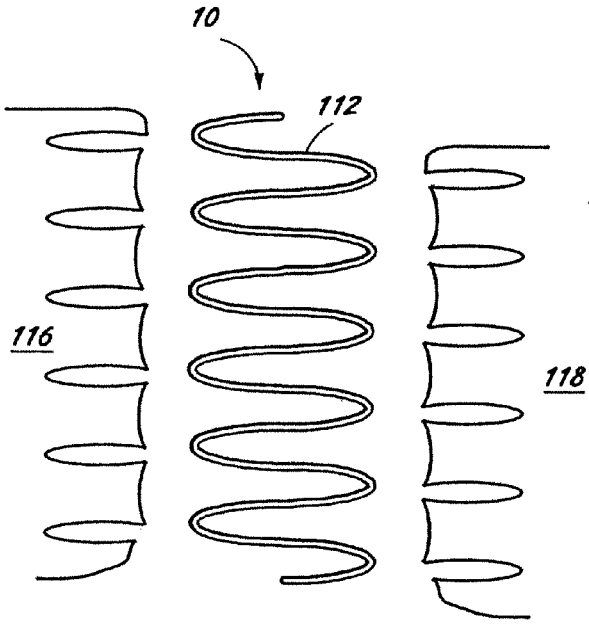
FIG. 9 shows a close-up of a hinged connection of a gabion according to the invention being broken.

In one example, illustrated by FIG. 7, the hinged connections 10 comprise helical springs 112 threaded through apertures 114 disposed towards the edges off each wall 116, 118, which are manufactured of sheet material. In FIG. 8, it can be seen that when a force F is applied to the hinged connection 10, the apertures 114 tend to deform. Upon application to sufficient force, as illustrated in FIG. 9, the apertures 114 tear-through, thereby disconnecting the hinged connection. One solution is to provide thicker sheet material. Where mesh-type walls are used, this is not necessarily a problem because the wires of the mesh can be thicker for a given overall gabion weight. However, to use sheet metal of the same thickness as the wire diameter could give rise to a prohibitively heavy gabion.

It is therefore desirable, additionally or alternatively to the aforementioned variants, to reinforce the sheet material walls in regions of increased stress.

The elongate panel section of relatively greater thickness may be provided by a folded over edge section of the substantially closed panel. In order to facilitate the folding over of the panel under factory conditions, the corners of the panel at either or both ends of the edge being folded may be removed prior to folding.

If further reinforcement is required, the edge of the sheet material can be folded a number of times or rolled-up.

Additionally or alternatively, additional reinforcing members may be affixed at or near to the edges of the sheet material. Preferably, such reinforcing members are strips that can be welded, glued or otherwise fastened in-situ.

Apertures in the sheet material may pass through one or more layers.

Where the sheet material is provided with reinforcement, the reinforcement may be faired to minimize/prevent snagging with other objects and/or a user's hands.

Fairings may be provided by way of trimming corners, removing burrs and/or providing rounded edges.

Suitably, the substantially closed panel is provided with means for connecting the panel pivotally to a neighbouring panel in the gabion. When such means comprise one or more apertures in the panel, for receiving a hinge member for example, the gabion may be provided with means for covering the one or more apertures to prevent or hinder a gabion fill material from escaping through said one or more apertures. Suitable covering means include cover strips, cover sheets, cover tapes, cover bands, cover ribbons, cover plates, cover coatings, cover layers, cover tabs, covering adhesives and covering gels, doughs, putties and the like. Alternatively, or as well, the one or more apertures may be provided with blocking means for at least partly blocking the egress of fines and other gabion fill materials from the gabion in use thereof. Suitable blocking means include blocking strips, blocking sheets, blocking tapes, blocking bands, blocking ribbons, blocking plates, blocking coatings, blocking layers, blocking tabs, blocking adhesives and blocking gels, doughs, putties and the like.

Other forms of pivotal connection between neighbouring side wall element panels are also contemplated within the scope of the invention—for example an interconnecting edge of a first neighbouring panel may be provided with a protruding portion interconnecting with a corresponding inset portion in the corresponding interconnection edge of a second neighbouring panel. A locking member may extend through the protruding portion and be received in the second neighbouring panel interconnection edge either side of the inset portion to lock the protruding portion into the inset portion in a pivotal fashion.

Alternatively, an elongate locking member may be provided in the interconnection edge of a first neighbouring side wall element panel, extending slightly beyond the interconnection edge at the top and bottom of the panel, and one or more linking members may then secure the locking member to the second neighbouring side wall element panel in the region extending slightly beyond the interconnection edge. Many other forms of pivotal connection may also be suitable in the realisation of the invention.

The gabion of the invention may be provided with a plurality of side wall element panels, each comprising a substantially closed panel having releasable interconnections which when released, allow the side wall element panels to open with respect to the gabion to allow access from the side of the gabion to any contents of the gabion compartments.

According to the present invention, there is provided a multi-compartmental gabion as hereinbefore described comprising opposed side walls connected together at spaced intervals along the length of the gabion by a plurality of partition walls, the spaces between neighbouring pairs of partition walls defining, together with the side walls, individual compartments of the multi-compartmental gabion, individual compartments of the multi-compartmental gabion being bounded by opposed side wall sections of the respective opposed side walls, the partition walls being pivotally connected to the side walls, and the side wall sections of the individual compartments comprising at least one substantially closed side wall element panel, pivotal connections being provided between neighbouring side wall element panels allowing the multi-compartmental gabion to fold concertina-wise for storage or transport.

At least one side wall element panel may be formed from a closed panel having an interconnection edge adjacent a neighbouring side wall element panel, an elongate panel being provided at or in the region of the interconnection edge, the thickness of the elongate panel being greater than the side wall element panel in the region thereof adjacent the elongate panel, the elongate panel section being provided with means for receiving a hinge member for pivotally connecting the side wall element panel to a neighbouring side wall element panel.

The partition walls may likewise be formed from closed panels. However, the partition walls may also be formed from an open mesh material, for example.

One multi-compartmental gabion of the invention therefore facilitates post-deployment recovery of the gabion by providing at least one openable side wall section along the length of the gabion. Preferably, a plurality of openable side wall sections are provided. More preferably all of the side wall sections, except those at the ends of the gabion in a gabion having more than two compartments, are openable. Most preferably, all of the side wall sections along the length of the gabion are openable. By "openable" is meant that the pivotal connection between the connected side wall element panels of the side wall section is provided by a hinge member provided on one or both of the connected side wall element panels and by a releasable locking member cooperating with the hinge member releasably to secure the pivotal connection therebetween. In some preferred embodiments of the invention, a first hinge member is provided on a first neighbouring side wall element panel and a second hinge member is provided on a second neighbouring side wall element panel, the releasable locking member cooperating with both the first hinge member and the second hinge member releasably to secure the pivotal connection. Opening of an openable side wall section is achievable by releasing the locking member and pulling apart the resulting unconnected side wall element panels.

Each side wall section may comprise a single side wall element panel, in which case the openable pivotal connection between neighbouring side wall element panels is located between neighbouring side wall sections. In this case the pivotal connection between neighbouring side wall element panels and the partition wall marking the boundary between corresponding neighbouring side wall sections is also openable to allow the first neighbouring side wall element panel to be released both from the second neighbouring side wall element panel and from the partition wall. Alternatively, each side wall section may comprise a plurality of side wall element panels, in which case the openable pivotal connection may be provided between neighbouring side wall element panels of a given side wall section. However, even when side wall sections comprise a plurality of side wall element panels, openable pivotal connections may be provided between neighbouring side wall sections as well as or instead of between neighbouring side wall element panels of a given side wall section. Multi-compartmental gabions comprising a plurality of side wall sections, with different numbers of side wall element panels constituting different side wall sections are also contemplated.

Deployment of the gabion of the invention will generally be effected by transporting the folded gabion to a deployment site, unfolding the gabion and filling each individual compartment of the gabion with a fill material. Generally the fill material will be dictated at least partly by the availability of suitable materials at the deployment site. Suitable fill materials include, but are not limited to, sand, earth, soil, stones, rocks, rubble, concrete, debris, snow, ice and combinations of two or more thereof.

There are a number of reasons why it could be desirable to open side wall sections of the gabion. For example, when the deployed gabion is to be decommissioned, it is often desirable to recover the gabion for environmental or aesthetic reasons, or simply out of consideration for the local population. Recovery of the gabion of the invention is facilitated by opening up all of the openable side wall sections of the gabion, at least partly removing the fill material from the compartments, and removing the gabion from site.

By way of further example, if the deployed gabion is damaged in use it may be desirable to replace or repair the damaged section of the gabion. Access via the openable side walls of the damaged section facilitates this. Similarly, when it is desired for reasons unconnected with damage to move, alter or replace a gabion section (for example if the position or orientation of the gabion requires alteration), such replacement is again facilitated by the capacity to remove at will fill material from selected gabion sections.

Although certain embodiments of the invention are characterised by the presence of at least one openable side wall section, and preferably by a plurality of openable side wall sections, it will often be desirable to provide each individual compartment of the gabion, optionally with the exception of the end compartments of the gabion (when the gabion has more than two compartments), with openable side wall sections. Accordingly, there is provided in accordance with the invention a multi-compartmental gabion as described wherein the pivotal connection between the connected side wall element panels of each of the side wall sections, or between each neighbouring side wall section, optionally with the exception of the end side wall sections, is provided by a hinge member provided between the first side wall element panel of a given side wall section and a second neighbouring side wall element panel of the given or a neighbouring side wall section, and a releasable locking member cooperating with the hinge member releasably to secure the pivotal connection. Preferably, a first hinge member is provided on the first side wall element panel and a second hinge member is provided on the second neighbouring side wall element panel, and the releasable locking member cooperates with both first and second hinge members releasably to secure the pivotal connection.

Furthermore, although a multi-compartmental gabion will be in accordance with the certain aspects of the invention if a plurality of openable side wall sections are provided on one side wall, it is also contemplated that openable side wall sections may be provided on both side wall sections of an individual compartment to allow access to the fill material from both sides. Accordingly, the invention provides a multi-compartmental gabion as described wherein the pivotal connection between the connected side wall element panels of at least a plurality of opposed side wall sections is provided by a hinge member provided between a first side wall element panel of a given side wall section and a second neighbouring side wall element panel of the given or a neighbouring side wall section, and by a releasable locking member cooperating with the hinge member releasably to secure the pivotal connection. Also contemplated within the scope of the invention is a multi-compartmental gabion as described wherein the pivotal connection between the connected side wall element panels of at least a plurality of opposed side wall sections is provided by a first hinge member provided on a first side wall element panel of a given side wall section and by a second hinge member on a second side wall element panel of the given or a neighbouring side wall section and by a releasable locking member connecting the first hinge member to the second hinge member.

Also contemplated is that openable side wall sections may be provided alternately on first and second opposed side walls along at least part of the length of the gabion. In this way when a gabion is being recovered, cooperating excavating equipment or personnel can be deployed on opposite sides of the gabion to remove fill material from neighbouring compartments simultaneously or in rapid succession if simultaneous excavation is undesirable for safety or other reasons. Thus, the invention provides a multi-compartmental gabion as described wherein the pivotal connection between the connected side wall element panels of at least a plurality of side wall sections staggered on alternating opposite side walls along at least part of the length of the gabion is provided by a hinge member provided between a first side wall element panel of a given side wall section and a second neighbouring side wall element panel of the given or a neighbouring side wall section, and by a releasable locking member cooperating with the hinge member releasably to secure the pivotal connection. Also contemplated within the scope of the invention is a multi-compartmental gabion as described wherein the pivotal connection between the connected side wall element panels of at least a plurality of side wall sections staggered on alternating opposite side walls along at least part of the length of the gabion is provided by a first hinge member provided on a first side wall element panel of a given side wall section and by a second hinge member on a second side wall element panel of the given side wall section and by a releasable locking member connecting the first hinge member to the second hinge member.

A side wall section preferably comprises a single side wall element panel, or two side wall element panels. However, a side wall section, a plurality of side wall sections, or each side wall section may, if desired comprise more than two side wall element panels. In this case pivotal connections are preferably provided between each side wall element panel.

Accordingly, the invention provides a multi-compartmental gabion as described wherein one or more side wall sections comprise a single side wall element panel. The invention also provides a multi-compartmental gabion as described wherein one or more side wall sections comprise two side wall element panels pivotally connected together (preferably openably pivotally connected together). Also contemplated within the scope of the invention is a multi-compartmental gabion as described wherein one or more side wall sections comprise more than two side wall element panels, with pivotal interconnections being provided between each neighbouring pair of side wall element panels.

One multi-compartmental gabion of the invention comprises a plurality of connected compartments, each compartment being bounded at opposed ends by a pair of opposed partition walls, and being bounded at opposed sides by a pair of opposed side wall sections, each side wall section comprising at one side wall element panel. In at least one, two, three or more individual compartments of the multi-compartmental gabion, at least one such side wall element panel is arranged to be openable, the mechanism of opening being operable when the compartment is loaded with a fill material.

The concertina-wise folding of the gabion may be effected by the side wall sections folding in towards the central longitudinal axis of the gabion, or by the side wall sections folding out away from the central longitudinal central axis of the gabion. The former manner will generally be preferable as the resulting folded gabion will have a relatively smaller cross-sectional surface area in a plane orthogonal to the central longitudinal axis of the gabion.

In one preferred embodiment of the invention the pivotal interconnection between connected walls and/or wall sections and/or wall elements is achieved by providing interconnected walls, wall sections and/or wall elements with a row of apertures along or in the region of an interconnection edge thereof and by providing a coil member helically threaded through a plurality of apertures along the interconnection edge. In the case of a straightforward (i.e.—non-openable) pivotal connection, a single coil member may be helically threaded through the connection edge apertures of two (or more) neighbouring walls, wall sections and/or wall elements to achieve pivotal interconnection therebetween. Accordingly, there is provided in accordance with the invention a multi-compartmental gabion as described wherein at least one pivotal connection is provided by the presence of a coil member helically threaded through connection edge apertures of connected walls, wall sections or wall elements.

In another preferred embodiment of the invention the openable pivotal interconnection between connected side wall element panels is achieved by providing the interconnected side wall element panels with a row of apertures along or in the region of an interconnection edge thereof and by providing a first coil member helically threaded through a plurality of apertures along the interconnection edge of a first side wall element panel, a second coil member helically threaded through a plurality of apertures along the interconnection edge of a second side wall element panel (connected to the first side wall element panel along the interconnection edge) and a releasable locking member threaded through overlapped first and second coil members. Thus, in the case of an openable pivotal connection, a pair of coil members may be helically threaded through the respective opposed connection edge apertures of two neighbouring side wall element panels, and a releasable locking member inserted through the overlapped coils of the opposed pair of coil members. Accordingly, there is provided in accordance with the invention a multi-compartmental gabion as described wherein at least one openable pivotal connection between neighbouring side wall element panels is provided by the presence of a pair of coil members helically threaded through respective connection edge apertures of neighbouring side wall element panels and by a releasable locking member threaded through the respective coil members when overlapped.

Thus, there is provided, in accordance with the invention, a multi-compartmental gabion, as described, wherein the or at least one hinge member comprises a helical coil.

The releasable locking member may be of any suitable shape or size and may for example comprise an elongated locking pin. The pin may be provided with a gripping protrusion at one end to facilitate manual insertion and/or removal of the locking pin. The gripping protrusion may for example comprise a loop at one end of the locking pin. Accordingly, there is provided in accordance with the invention a multi-compartmental gabion as described wherein at least one locking member comprises an elongated locking pin.

The side walls, side wall sections, side wall element panels and/or partition walls preferably comprise one or more panel sections of any suitable material, for example steel, aluminium, titanium, any other suitable metal or alloy, or from a plastic, ceramic or natural material such as timber, sisal, jute, coir or seagrass. Normally, steel is preferred, in which case the steel is preferably treated to prevent or hinder steel erosion during deployment of the gabion. The panel is a substantially closed panel which acts in use of the gabion to contain a gabion fill material without the need for a gabion compartment lining material, such as a geotextile liner. However, the gabion of the invention may be used together with a suitable lining material if necessary. In the case of a closed panel, connection edge apertures where needed will normally be machined or otherwise provided in or in the region of the panel edge.

The gabion of the invention may comprise pivotally interconnected, substantially closed, side wall element panels which are connected together under factory conditions so that the gabion can take a flattened form for transportation to site where it can be erected to take a form in which panels thereof define side, partition and end walls and an open top through which the compartments of the gabion may be filled. Preferably, under factory conditions said panels define side, partition and end walls and are pivotally interconnected edge to edge and are relatively foldable to lie face to face in the flattened form for transportation to site and can be relatively unfolded to bring the gabion to the erected condition without the requirement for any further connection of the side, partition or end walls on site.

In preferred embodiments of the invention, the side walls of the gabion each comprise a plurality of side panels pivotally connected edge to edge and folded concertina fashion one relative to another. The side walls are preferably connected by partition walls which are pivotally connected thereto, the gabion structure being adapted to be erected on site by pulling it apart by the end walls so that when it is moved from the flattened form to the erected condition the side walls unfold and define with the end walls and partition walls an elongated wall structure having a row of cavities to be filled with a fill material and of which each partition wall is common to the pair of cavities adjacent the partition wall.

Referring in more detail to FIGS. 1A-1C and 2, there is shown multi-compartmental gabion 1 comprising opposed side walls 2, 3 connected together at spaced intervals along the length of gabion 1 by a plurality of partition walls 4, 5, 6 defining, together with side walls 2, 3 individual compartments 7, 8, 9 of multi-compartmental gabion 1. Individual compartment 8 (and other similar individual compartments) of multi-compartmental gabion 1 is bounded by opposed side wall sections 10, 11 of the respective opposed side walls 2, 3. Partition walls 4, 5 (and similar partition walls) are pivotally connected to side walls 2, 3 at hinge points 11, 11', 12, 12'.

In the embodiments shown in FIGS. 1A-1C and 2, each side wall section 10, 11 of multi-compartmental gabion 1 comprises two side wall element panels 13, 13'; 14, 14', with pivotal connections being provided between neighbouring side wall element panels 13, 13', and between neighbouring side wall element panels 14, 14'.

The pivotal connections between partition walls 4, 5 (and other partition walls in the multi-compartmental gabion) and side walls 2, 3, and the pivotal connections between neighbouring side wall element panels 13, 13'; 14, 14', allow multi-compartmental gabion 1 to fold concertina-wise for flat-packing in transportation and storage. In the embodiments shown in FIGS. 1A-1C and 2, the concertina-wise folding preferably operates so that the pivotal connections between neighbouring side wall element panels 13, 13'; 14, 14', move inwardly with respect to the longitudinal axis of multi-compartmental gabion 1 so that the width of the flat-packed gabion is at least approximately corresponding to the width of partition walls 4, 5, 6.

The side wall element panels may be provided with texture, ribbing or other irregularities in order to maintain effective strength of the panel whilst minimising its weight, and/or to provide decorative effect.

Figure 2:
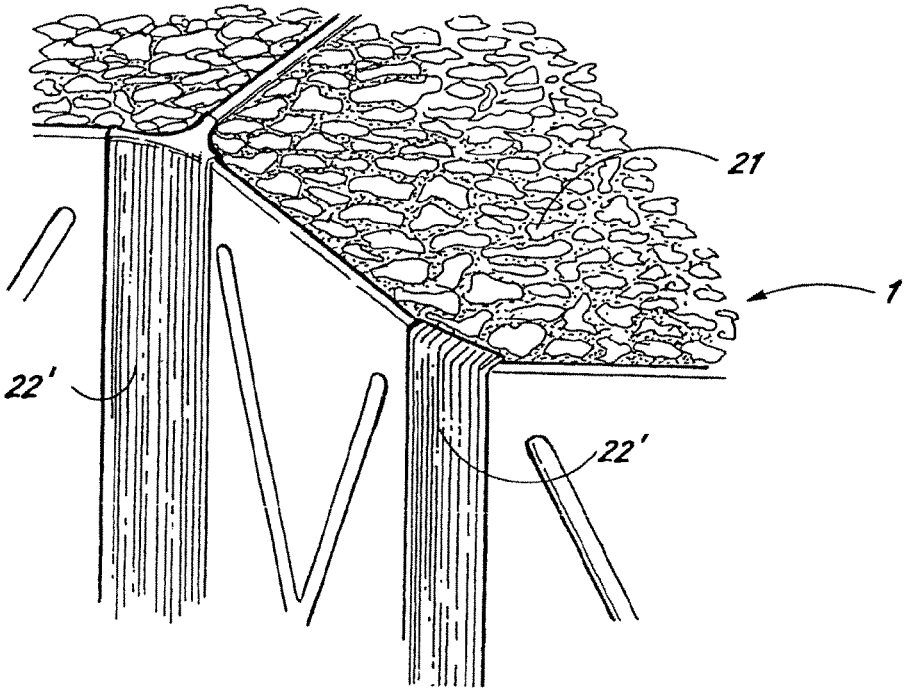
FIG. 2 shows the multi-compartmental gabion of FIGS. 1A-1C filled with a gabion fill material.
Figure 3A:
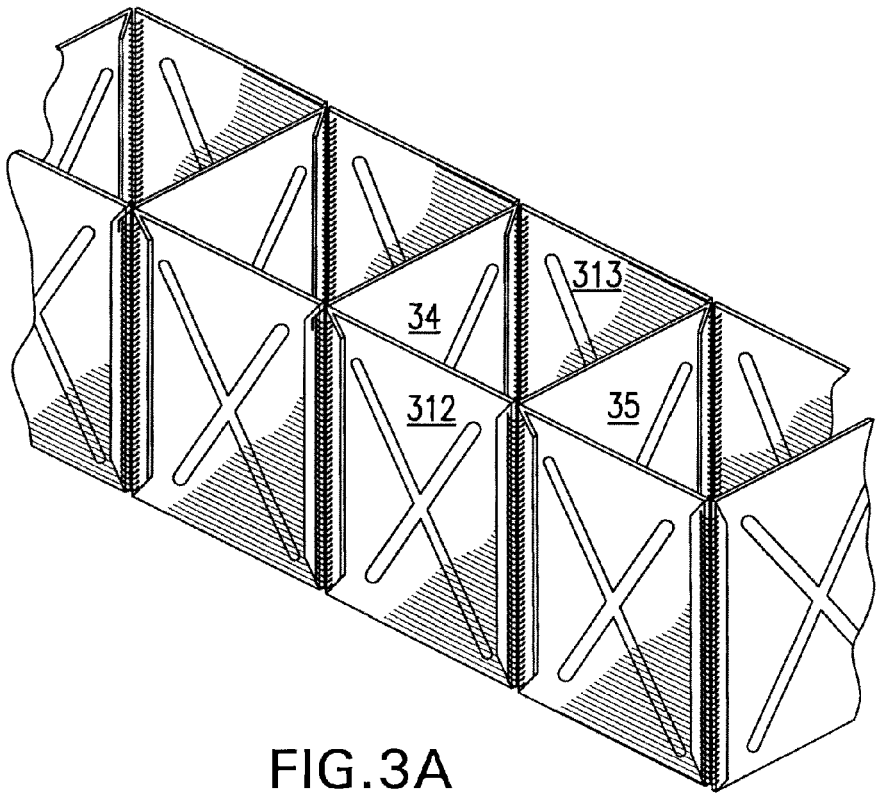
FIGS. 3A-3D shows a perspective view of a multi-compartmental gabion in accordance with a second embodiment of the invention.
Figure 3B:
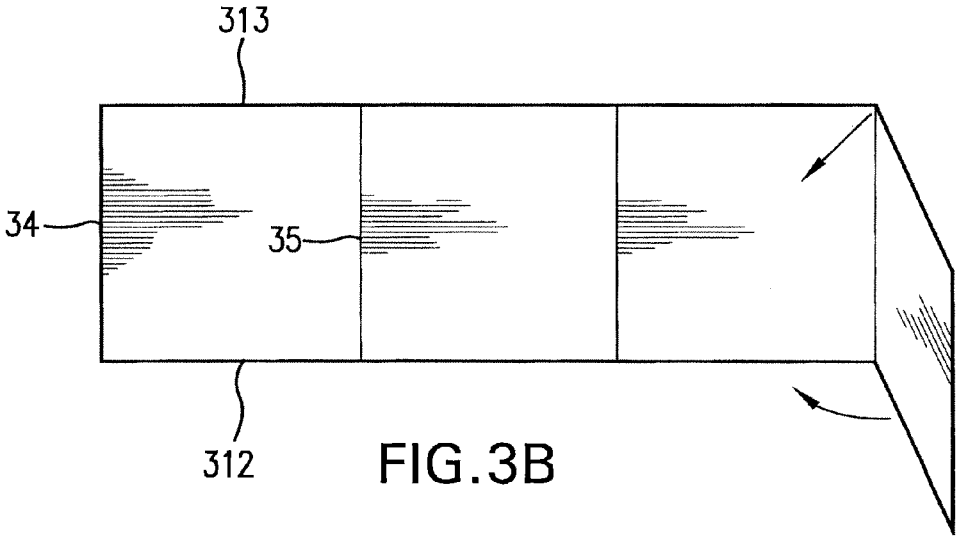
Figure 3C:
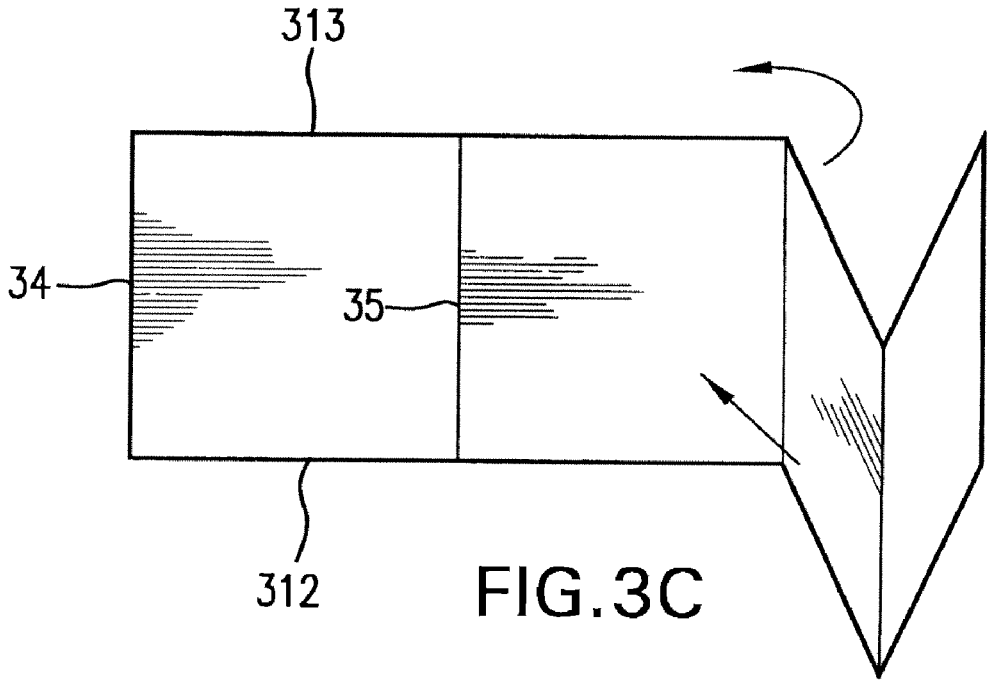
Figure 3D:
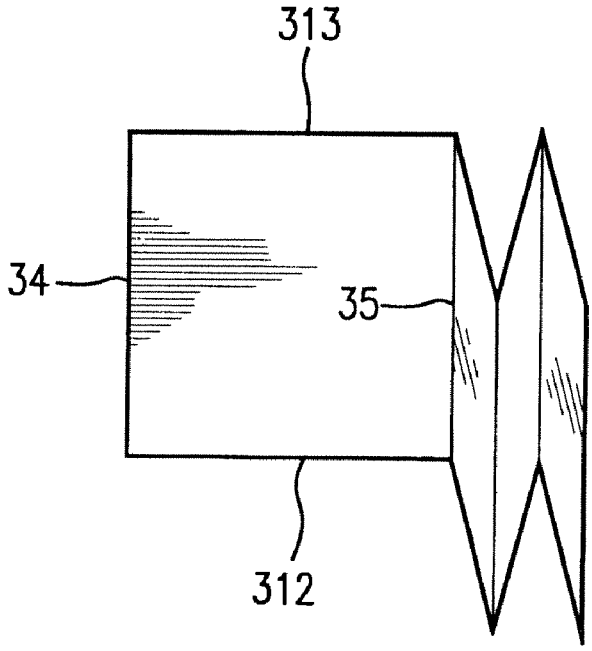

Referring to FIG. 2, multi-compartmental gabion 1 is shown filled with a gabion fill material 21. Fill material 21 may be selected from any suitable available material, as hereinbefore described. Rough earth and stones are shown as the fill material in FIG. 2. FIG. 2 also shows a cover strip 22, 22' over the hinged interconnection edges of the gabion.

Referring now to FIGS. 3A-3D, there is shown a second embodiment of the multi-compartmental gabion, in which each individual compartment comprises a pair of partition walls 34, 35, and a pair of opposed side wall element panels 312, 313. Pivotal connections therebetween allow the gabion to fold concertina-wise (first one way, and then the other) for flat packing and storage.

Figure 4:
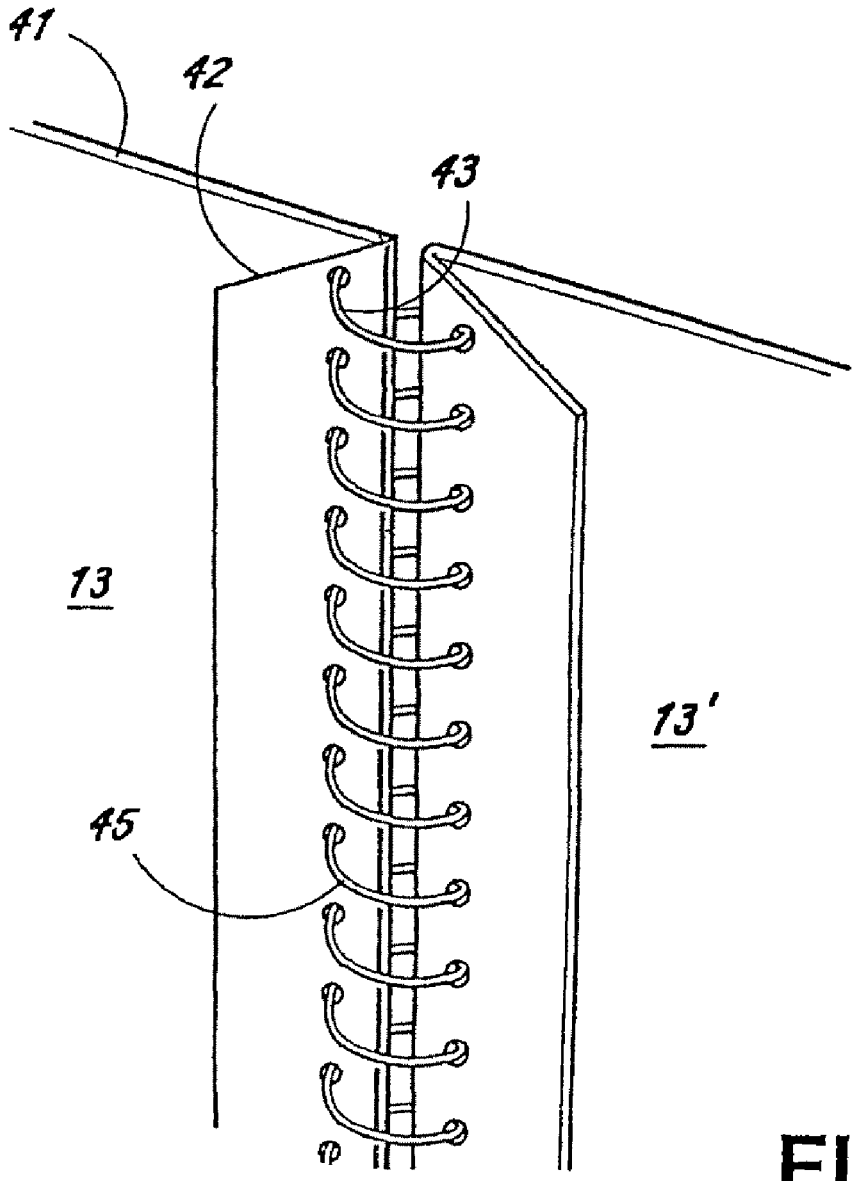
FIG. 4 shows in close-up perspective view the pivotal connection between neighbouring side wall element panels of the gabion of FIGS. 1A-1C, 2 or 3A-3D.

Referring now to FIG. 4, there is shown a close-up perspective view of the pivotal connection between neighbouring side wall element panels 13 and 13'. This pivotal connection may be between two side wall element panels only, or may also include a partition wall. For convenience in the drawing, partition wall 5 has been omitted from the close-up perspective view. However, it will be understood that partition wall 5 may share this particular pivotal connection in a similar fashion. Referring to FIG. 4, side wall element 13 comprises a substantially closed panel 41 comprising a folded over edge region 42 in which is machined a row of interconnection edge apertures 43. Prior to folding of folded over edge portion 42, the corners of side wall element panel 41 at either end of the interconnection edge are removed to facilitate folding. Pivotal connection therebetween is effected by a helical coil 45 which is helically threaded through the interconnection edge apertures of the neighbouring panels. Although not shown in FIG. 4, loose end 45 of helical coil 44 may be bent round or otherwise prevented from accidentally disengaging with the top most aperture of side wall element 13, and weakening the pivotal connection by such disengagement.

Figure 5:
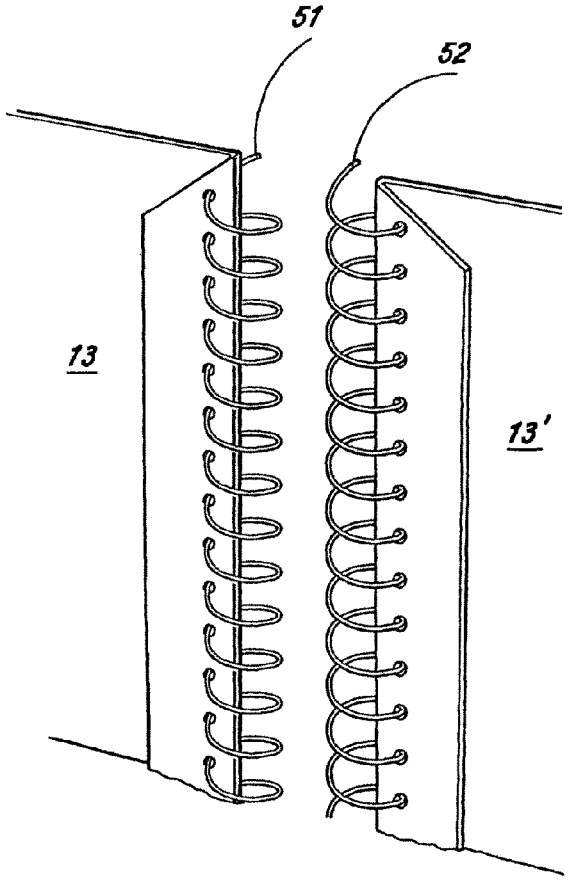
FIG. 5 shows in close-up perspective view the optional openable pivotal connection between neighbouring side wall element panels of the multi-compartmental gabion of FIGS. 1A-1C, 2 or 3A-3D, before the releasable locking member is installed.
Figure 6:
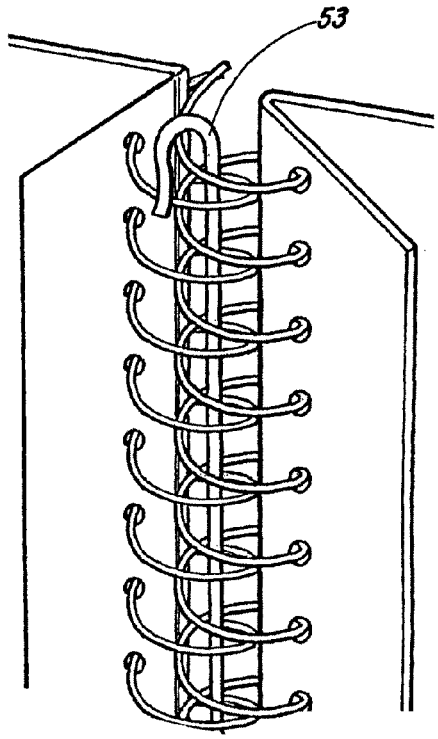
FIG. 6 shows in close-up perspective view the openable pivotal connections were made between the components of the FIG. 5 drawing.

Referring now to FIG. 5, there is shown in close-up perspective view the optional openable pivotal connection between neighbouring side wall elements 13, 13'. In this case, both neighbouring closed panels are provided with helical coil members threaded helically through the interconnection edge apertures thereof. The first hinge member 51 and the second hinge member 52 are thereby provided. Releasable locking member 53 is shown in FIG. 6 connecting the overlapped helical coils.

Referring now to FIGS. 10 to 15, cross-sections through the gabion are shown where the walls 126 are manufactured of sheet metal. As can be seen, a helical spring 112 is threaded through apertures 114 in the side wall 126.

In FIG. 10, a single fold 130 is provided to reinforce the edge of the wall 126. The aperture 114 passes through both thicknesses 132 of the fold 130.

In FIG. 11, a double fold 134 is provided and the aperture 114 passes through all three thicknesses 136 of the fold 134.

In FIG. 12, a single fold 130 is provided, but the aperture 114 only passes through a single thickness 132.

In FIG. 13, a double fold 134 is provided, but the aperture 114 only passes through a single thickness 136.

In FIGS. 14 and 15, a reinforcing strip 138 is stuck to the wall 126 using a layer of adhesive 140. The aperture can either pass through the reinforcing strip 138, or the wall 126, respectively.

In FIGS. 16, 17 and 18, the aperture only passes through the wall 126. Strength/reinforcement advantages can nonetheless be attained so long as the spring 112 is pulled in the direction indicated by arrow A. This arrangement has the further advantage that the aperture 114 need only be drilled or punched through one thickness of material, which reduces manufacturing costs and/or complexity.

FIGS. 16 to 19 show partial cross-sections of the gabion where the wall 126 is manufactured of a plastic material. As can be seen, a thicker, reinforced region 142 is relatively easily formed using a suitable moulding technique. In FIGS. 17 to 19, a reinforcing wire 144 has been co-moulded with the wall 126 to further reinforce the edge thereof.

A further possible variant of the invention sees reinforcing wires or a reinforcing mesh 146 being integrally mounded with the wall 126 as illustrated in FIG. 17. This feature means that much thinner wall thicknesses can be provided for a given strength requirement.

Figure 20:
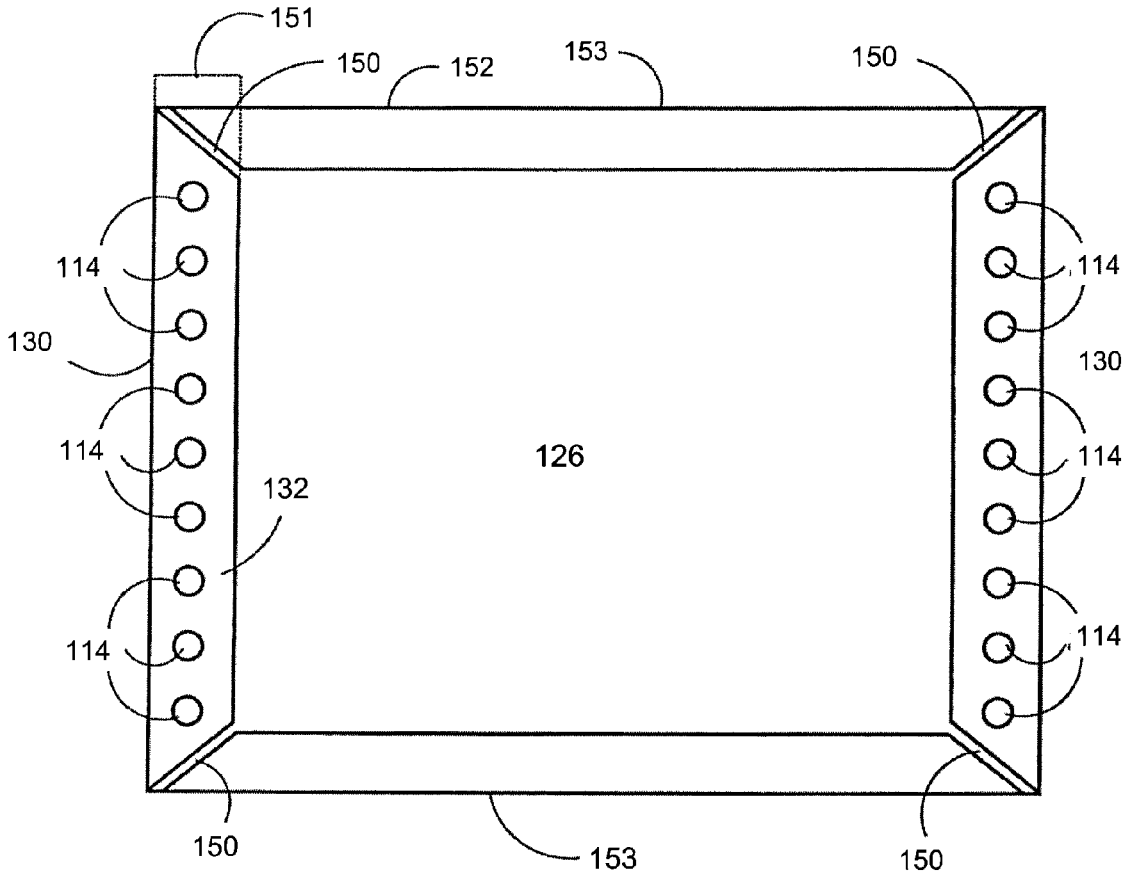
FIG. 20 shows a side view of a wall of the gabion.

Finally, FIG. 20 shows a side view of a wall panel 126 having an edge reinforcement as illustrated in FIG. 6. As can be seen, the corners of the fold 130 have been cut away 150 to prevent sharpe edges 151 (indicated by a dotted line) protruding above the edge 152 of the wall 126.

As can also be seen in FIG. 16, the top and bottom edges 153 of the wall 126 have also been folded over to facilitate manual handling of the gabion and to prevent damage to neighbouring objects (not shown) such as a floor surface.

What is claimed is:

1. A multi-compartmental gabion comprising opposed side walls connected together at spaced intervals along the length of the gabion by a plurality of partition walls, the spaces between neighboring pairs of partition walls defining, together with the side walls, individual compartments of the multi-compartmental gabion, individual compartments of the multi-compartmental gabion being bounded by opposed side wall sections of the respective opposed side walls, the partition walls being pivotally connected to the side walls, and the side wall sections of the individual compartments comprising at least one substantially closed side wall element panel, wherein the or each substantially closed panel is manufactured of a relatively rigid sheet material, pivotal connections being provided between neighboring side wall element panels allowing the multi-compartmental gabion to fold concertina-wise for storage or transport, wherein the substantially closed panel is provided with means for receiving a hinge member for the purpose of connecting the side wall element panel pivotally to a neighboring side wall element panel and/or to a partition wall, and further wherein the hinge receiving means comprises one or more apertures in the panel, with means for covering or blocking the one or more apertures to prevent or hinder a gabion fill material from escaping through said one or more apertures.

2. The multi-compartmental gabion according to claim 1, wherein the side wall element panel is of a rigid material.

3. The multi-compartmental gabion according to claim 2, wherein the rigidity of the material is sufficient to prevent excessive bulging of the side wall element panel when the gabion is filled with a fill material.

4. The multi-compartmental gabion according to claim 1, wherein the hinge receiving means are provided on a region of the closed panel of greater thickness than an adjacent region of the panel.

5. The multi-compartmental gabion according to claim 4, wherein the relatively greater thickness of the hinge receiving means section of the panel helps to prevent tearing of the panel by the hinge member in use of the gabion when the side walls of the gabion act to restrain the gabion fill material.

6. The multi-compartmental gabion according to claim 4, wherein the region of the closed panel of relatively greater thickness is provided at or in the region of an interconnection edge of the closed panel.

7. The multi-compartmental gabion according to claim 6, wherein the region of relatively greater thickness is an elongate panel region alongside or at the interconnection edge.

8. The multi-compartmental gabion according to claim 7, wherein the elongate panel section of relatively greater thickness is provided by a folded over edge section of the substantially closed panel.

9. A multi-compartmental gabion according to claim 8, wherein in order to facilitate the folding over of the panel, the corners of the panel at either or both ends of the edge being folded are removed prior to folding.

10. The multi-compartmental gabion according to claim 1, wherein the hinge receiving means comprises one or more apertures in the panel.

11. The multi-compartmental gabion according to claim 10, wherein a row of apertures are provided.

12. The multi-compartmental gabion according to claim 1, wherein the covering means is selected from the group consisting of cover strips, cover sheets, cover tapes, cover bands, cover ribbons, cover plates, cover coatings, cover layers, cover tabs, covering adhesives and covering gels, doughs, and putties.

13. The multi-compartmental gabion according to claim 1, wherein the blocking means is selected from the group consisting of blocking strips, blocking sheets, blocking tapes, blocking bands, blocking ribbons, blocking plates, blocking coatings, blocking layers, blocking tabs, blocking adhesives and blocking gels, doughs, and putties.

14. A multi-compartmental gabion comprising opposed side walls connected together at spaced intervals along the length of the gabion by a plurality of partition walls, the spaces between neighboring pairs of partition walls defining, together with the side walls, individual compartments of the multi-compartmental gabion, individual compartments of the multi-compartmental gabion being bounded by opposed side wall sections of the respective opposed side walls, the partition walls being pivotally connected to the side walls, the side walls comprising a plurality of side wall element panels, at least one side wall element panel comprising a substantially closes panel, wherein the or each side wall element panel is manufactured of a relatively rigid sheet material, pivotal connections being provided between neighboring side wall element panels allowing the multi-compartmental gabion to fold concertina-wise for storage or transport, wherein at least one side wall element panel is formed from a closed panel having an interconnection edge adjacent a neighboring side wall element panel, an elongate panel being provided at or in the region of the interconnection edge, the thickness of the elongate panel being greater than the side wall element panel in the region thereof adjacent the elongate panel, the elongate panel section being provided with means for receiving a hinge member for pivotally connecting the side wall element panel to a neighboring side wall element panel.

15. A multi-compartmental gabion comprising opposed side walls connected together at spaced intervals along the length of the gabion by a plurality of partition walls, the spaces between neighboring pairs of partition walls defining, together with the side walls, individual compartments of the multi-compartmental gabion, individual compartments of the multi-compartmental gabion being bounded by opposed side wall sections of the respective opposed side walls, the partition walls being pivotally connected to the side walls, the side walls comprising a plurality of side wall element panels, at least one side wall element panel comprising a substantially closes panel, and having releasable interconnections that when released allow the side wall element panels to open with respect to the gabion to allow access from the side of the gabion to any contents of the gabion compartments, wherein the or each side wall element panel is manufactured of a relatively rigid sheet material, pivotal connections being provided between neighboring side wall element panels allowing the multi-compartmental gabion to fold concertina-wise for storage or transport, wherein the pivotal connection between the connected side wall element panels of each of the side wall sections, or between each neighboring side wall section, optionally with the exception of the end side wall sections, is provided by a hinge member provided between the first side wall element panel of a given side wall section and a second neighboring side wall element panel of the given or a neighbouring side wall section, and a releasable locking member cooperating with the hinge member releasably to secure the pivotal connection.

16. The multi-compartmental gabion according to claim 15, wherein a first hinge member is provided on the first side wall element panel and a second hinge member is provided on the second neighboring side wall element panel.

17. The multi-compartmental gabion according to claim 16, wherein the releasable locking member cooperates with both first and second hinge members releasably to secure the pivotal connection.

* * * * *